US007739760B2

(12) United States Patent
Wang et al.

(10) Patent No.: US 7,739,760 B2
(45) Date of Patent: Jun. 22, 2010

(54) BEDSTEAD ASSEMBLY WITH A FOLDABLE SUPPORT FRAME

(76) Inventors: Cheng-Chung Wang, 9F, No. 24, Sung-Chih Rd., Hsin-I Dist., Taipei City (TW); Kenneth Wang, 9F, No. 24, Sung-Chih Rd., Hsin-I Dist., Taipei City (TW)

( * ) Notice: Subject to any disclaimer, the term of this patent is extended or adjusted under 35 U.S.C. 154(b) by 227 days.

(21) Appl. No.: 11/937,648

(22) Filed: Nov. 9, 2007

(65) Prior Publication Data

US 2008/0109958 A1 May 15, 2008

(30) Foreign Application Priority Data

Nov. 10, 2006 (CN) ..... 2006 1 0148452

(51) Int. Cl.
*A47C 19/12* (2006.01)

(52) U.S. Cl. ..... 5/176.1; 5/177; 5/180; 5/202

(58) Field of Classification Search ..... 5/174–180, 5/201, 202, 200.1, 400, 401, 310, 285; 160/135, 160/161, 377; 248/150, 166
See application file for complete search history.

(56) References Cited

U.S. PATENT DOCUMENTS

| | | | | |
|---|---|---|---|---|
| 3,881,202 | A * | 5/1975 | Tyhanic | 5/176.1 |
| 4,125,912 | A * | 11/1978 | Courter | 5/400 |
| 4,788,727 | A * | 12/1988 | Liu | 5/679 |
| 2006/0107456 | A1 * | 5/2006 | Joseph | 5/2.1 |
| 2009/0025143 | A1 * | 1/2009 | Oh | 5/201 |

* cited by examiner

*Primary Examiner*—Peter M. Cuomo
*Assistant Examiner*—William Kelleher
(74) *Attorney, Agent, or Firm*—Quintero Law Office

(57) ABSTRACT

A bedstead assembly includes a support frame and a top plate unit disposed on the support frame. The support frame includes a rectangular foldable frame member convertible between unfolded and folded states. The foldable frame member includes a plurality of parallel non-foldable plates and a plurality of pairs of foldable plates. Any two adjacent non-foldable plates interconnect pivotally one corresponding pair of foldable plates to define a void space when the foldable frame member is in the unfolded state. The void spaces in the foldable frame member are arranged along a direction parallel to the foldable plates. Pivotable plate portions of the foldable plates are perpendicular to the non-foldable plates when the foldable frame member is in the unfolded state, and are parallel to the non-foldable plates when the foldable frame member is in the folded state.

11 Claims, 4 Drawing Sheets

BEDSTEAD ASSEMBLY WITH A FOLDABLE SUPPORT FRAME

CROSS-REFERENCE TO RELATED APPLICATION

This application claims priority of Chinese Application No. 200610148452.X, filed on Nov. 10, 2006.

BACKGROUND OF THE INVENTION

1. Field of the Invention

This invention relates to a bedstead assembly, and more particularly to a bedstead assembly that includes a foldable support frame.

2. Description of the Related Art

A conventional bedstead assembly occupies a substantial space to thereby result in inconvenience during transport and storage thereof.

SUMMARY OF THE INVENTION

The object of this invention is to provide a bedstead assembly that includes a support frame, which is foldable during transport and storage thereof.

According to this invention, a bedstead assembly includes a rigid support frame and a top plate unit disposed on and above the support frame. The support frame includes a rectangular foldable frame member convertible between unfolded and folded states. The foldable frame member includes a plurality of parallel non-foldable plates and a plurality of pairs of foldable plates. Any two adjacent ones of the non-foldable plates interconnect pivotally one corresponding pair of the foldable plates to define a void space when the foldable frame member is in the unfolded state. The void spaces in the foldable frame member are arranged in a row along a direction parallel to the foldable plates. Pivotable plate portions of the foldable plates are perpendicular to the non-foldable plates when the foldable frame member is in the unfolded state, and are parallel to the non-foldable plates when the foldable frame member is in the folded state.

BRIEF DESCRIPTION OF THE DRAWINGS

These and other features and advantages of this invention will become apparent in the following detailed description of a preferred embodiment of this invention, with reference to the accompanying drawings, in which.

DETAILED DESCRIPTION OF THE PREFERRED EMBODIMENT

Figure 1:
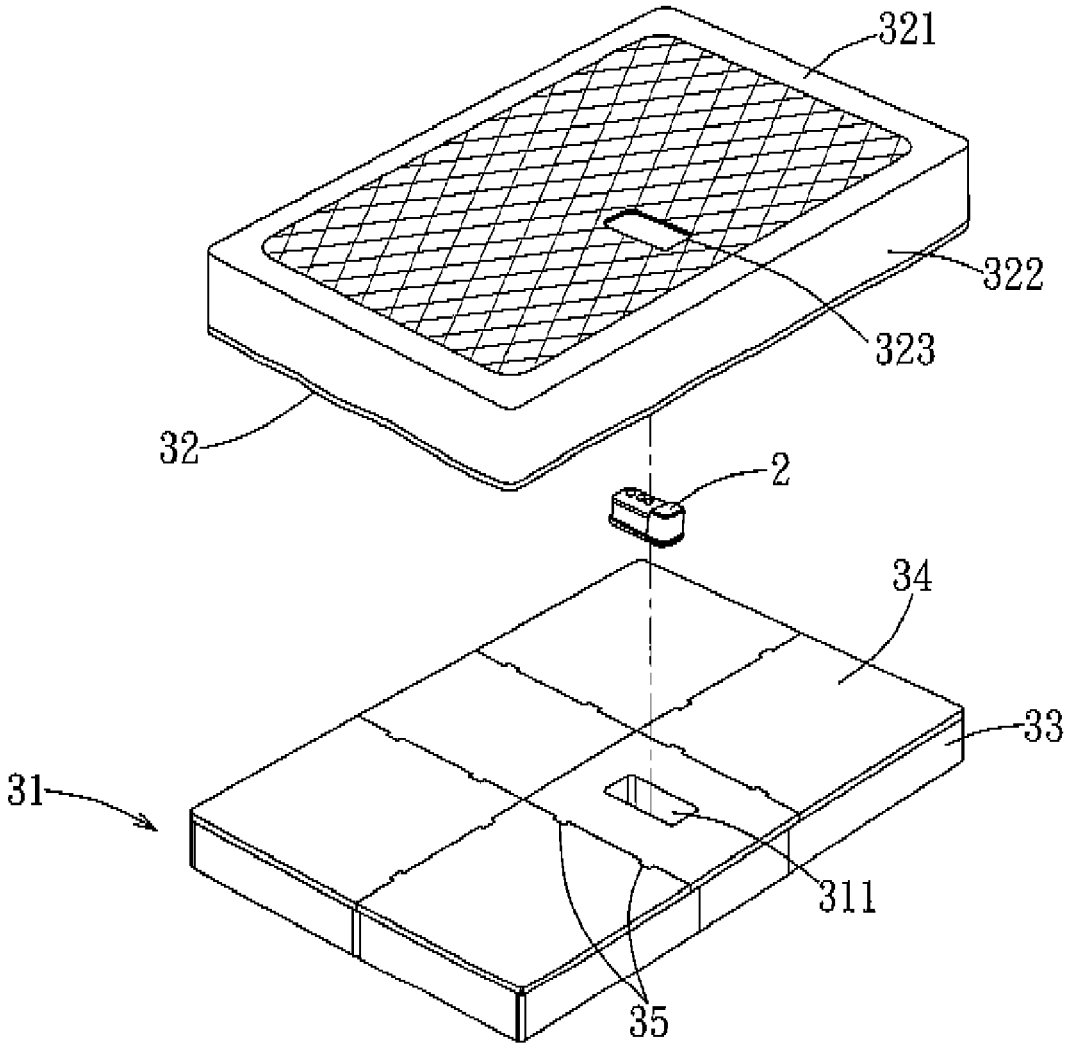
FIG. 1 is a partly exploded perspective view of the preferred embodiment of a bedstead assembly according to this invention.

Referring to FIG. 1, the preferred embodiment of a bedstead assembly 3 according to this invention includes a bedstead body 31 and a cover 32 made of a fabric for covering the bedstead body 31. The cover 32 has a rectangular top sheet 321 disposed on and above the bedstead body 31, and a surrounding sheet 322 extending downwardly from a periphery of the top sheet 321 and disposed around the bedstead body 31. The bedstead body 31 and the cover 32 are formed respectively with two aligned holes 311, 323 for receiving an electrical air pump unit 2.

Figure 2:
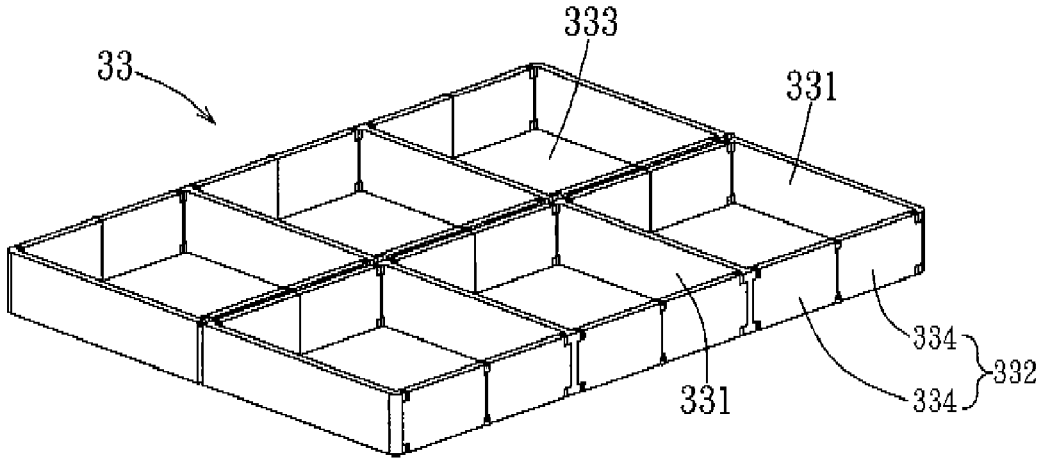
FIG. 2 is a perspective view of a support frame of the preferred embodiment in an unfolded state.

With further reference to FIG. 2, the bedstead body 31 includes a rigid support frame 33 and a top plate unit disposed on and above the support frame 33 and consisting of six coplanar top plates 34 made of a plastic material. One of the top plates 34 is formed with the hole 311 therethrough. Any adjacent two ones of the top plates 34 are interconnected removably by two tongue and groove engagement units 35.

Figure 6:
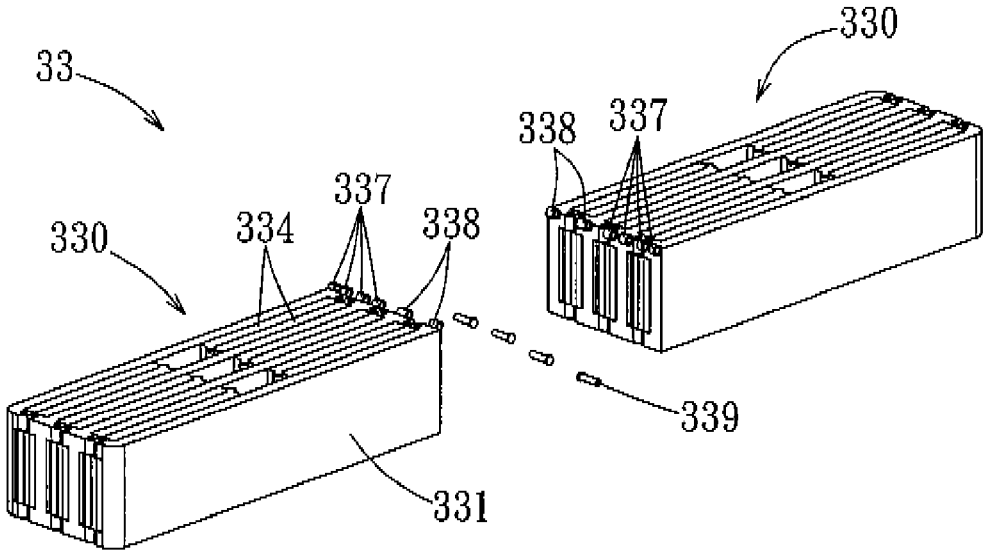
FIG. 6 is a partly exploded perspective view of the support frame of the preferred embodiment in a fully folded state.

With additional reference to FIG. 6, the support frame 33 includes a pair of rectangular first and second foldable frame members 330 each convertible between an unfolded state shown in FIG. 2 and a folded state shown in FIG. 6. Each of the first and second foldable frame members 330 includes four parallel non-foldable plates 331 and three pairs of the foldable plates 332. Any two adjacent ones of the non-foldable plates 332 interconnect pivotally one corresponding pair of foldable plates 332 to define a void space 333 when a corresponding one of the first and second foldable frame members 330 is in the unfolded state. As such, the void spaces 333 in each of the first and second foldable frame members 330 are arranged in a row along a direction perpendicular to the non-foldable plates 331. The top plates 34 cover the void spaces 333, respectively. Each of the foldable plates 332 includes two pivotable plate portions 334 having outer ends connected respectively and pivotally to the corresponding non-foldable plates 331, and inner ends interconnected pivotally. In the unfolded state, the pivotable plate portions 334 of the foldable plates 332 are perpendicular to the non-foldable plates 331. In the folded state, the pivotable plate portions 334 of the foldable plates 332 are parallel to the non-foldable plates 331.

Figure 3:
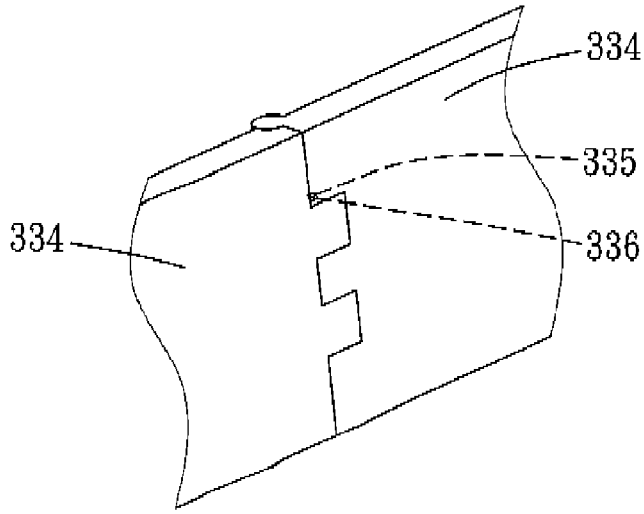
FIG. 3 is a fragmentary perspective view of a foldable plate of a foldable frame member of the support frame of the preferred embodiment in an unfolded state.
Figure 4:
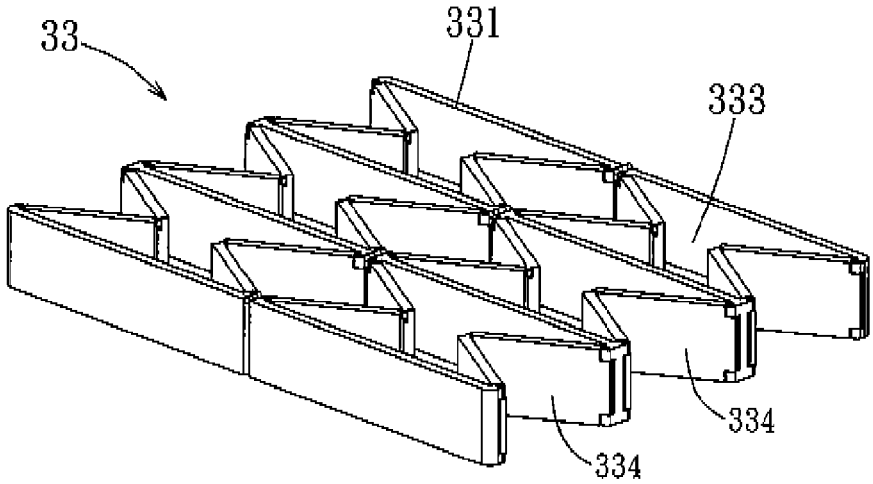
FIG. 4 is a perspective view of the foldable frame member of the preferred embodiment in a semi-folded state.
Figure 5:
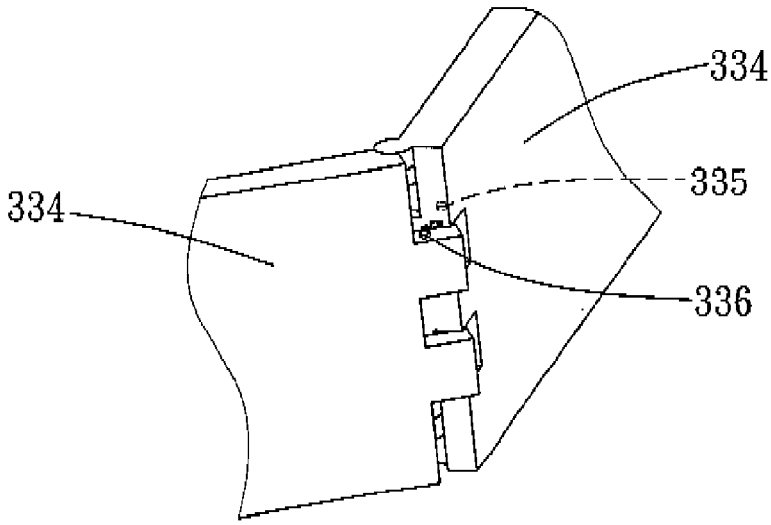
FIG. 5 is a fragmentary perspective view of the foldable plate of the preferred embodiment in a semi-folded state.
Figure 7:
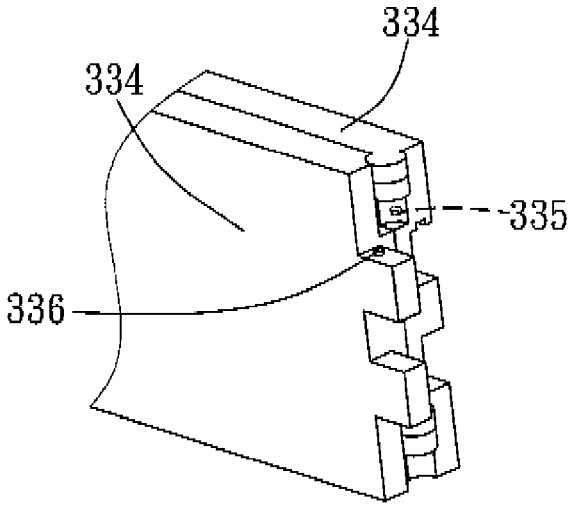
FIG. 7 is a fragmentary perspective view of the foldable plate of the preferred embodiment in a fully folded state.

With particular reference to FIGS. 3 and 5, each of the foldable plates 332 has a positioning unit including a positioning hole 335 formed in one of the pivotable plate portions 334 of the corresponding foldable plate 332, and a positioning projection 336 extending from the other of the pivotable plate portions 334 of the corresponding foldable plate 332 and engaging the positioning hole 335 when a corresponding one of the first and second foldable frame members 330 is in the unfolded state. Each of the pivotable plate portions 334 is connected pivotally to one end of the corresponding non-foldable plate 331, and the pivotable plate portions 334 of each of the foldable plates 332 are interconnected in such a manner that, when the corresponding one of the first and second foldable frame members 330 is in the unfolded state, each of the pivot plate portions 334 is pivotable in only a direction toward the other end of the corresponding non-foldable plate 331, as shown in FIGS. 4 and 5. When the first and second foldable frame members 330 are fully folded, the pivotable plate portions 334 of each of the foldable plates 332 abut against each other, and are sandwiched between the corresponding non-foldable plates 331. In this state, the positioning projections 336 are spaced apart from the positioning holes 335, respectively, as shown in FIG. 7.

With particular reference to FIG. 6, the first foldable frame member 330 has an end connected pivotally to an end of the second foldable frame member 330 by four pivot units. The pivot units are disposed at adjacent ends of the first and second foldable frame members 330, and are adjacent to aligned top surfaces of the first and second foldable frame members 330. Each of pivot units includes two side sleeves 337 disposed on one of the first and second foldable frame members 330, a middle sleeve 338 disposed on the other of the first and second foldable frame members 330 and between the side sleeves 337, and a pivot pin 339 extending through the side sleeves 337 and the middle sleeve 338. As such, one of the folded frame members 330 can be pivoted about the pivot pins 339 to abut against the top surface of the other of the first and second foldable frame members 330, thereby resulting in convenience during transport and storage thereof.

Alternatively, the bedstead body 31 may include only one foldable frame member 330, and the foldable frame member 330 may include only two non-foldable plates 331 and two foldable plates 332 interconnecting the non-foldable plates 331 to define only one void space.

With this invention thus explained, it is apparent that numerous modifications and variations can be made without departing from the scope and spirit of this invention. It is therefore intended that this invention be limited only as indicated by the appended claims.

We claim:

1. A bedstead assembly including a rigid support frame and a top plate unit disposed on and above said support frame, wherein said support frame includes a first foldable frame member convertible between unfolded and folded states, at least one pivot unit, and a second foldable frame member having an end connected pivotally to an end of said first foldable frame member by said pivot unit, each of said first and second foldable frame members including a plurality of parallel non-foldable plates and at least one pair of foldable plates, any two adjacent ones of said non-foldable plates interconnecting pivotally one corresponding pair of said foldable plates to define a void space when said first foldable frame member is in the unfolded state, each of said foldable plates including two pivotable plate portions having outer ends connected respectively and pivotally to said corresponding non-foldable plates such that each of said pivotable plate portions is pivotable relative to a corresponding one of said non-foldable plates about a first axis, and inner ends interconnected pivotally, said first and second foldable frame members having respectively aligned top surfaces, said pivot unit being disposed adjacent to said top surfaces such that one of said first and second foldable frame members is pivotable about a second axis to abut against said top surface of the other of said first and second foldable frame member, said first and second axes forming an angle therebetween, said pivotable plate portions being generally perpendicular to said non-foldable plates when said support frame is in the unfolded state and being generally parallel to said non-foldable plates when said support frame is in the folded state.

2. The bedstead assembly as claimed in claim 1, wherein said top plate unit covers said void spaces in said first foldable frame member.

3. The bedstead assembly as claimed in claim 2, wherein said top plate unit includes a plurality of coplanar top plates that are removably interconnected and that cover respectively said void spaces in said support frame.

4. The bedstead assembly as claimed in claim 1, further comprising a cover made of a fabric for covering said support frame and said top plate unit.

5. The bedstead assembly as claimed in claim 4, wherein said cover has a rectangular top sheet disposed on and above said top plate unit, and a surrounding sheet extending downwardly from a periphery of said top sheet and disposed around an assembly of said support frame and said top plate unit.

6. The bedstead assembly as claimed in claim 1, wherein each of said foldable plates has a positioning unit including a positioning hole formed in one of said pivotable plate portions of a corresponding one of said foldable plates, and a positioning projection that extends from the other of said pivotable plate portions of the corresponding one of said foldable plates, that engages said positioning hole so as to maintain said foldable frame member in the unfolded state when said first foldable frame member is in the unfolded state, and that is spaced apart from said positioning hole when said first foldable frame member is in the folded state.

7. The bedstead assembly as claimed in claim 1, wherein each of said pivotable plate portions is connected pivotally to one end of a corresponding one of said non-foldable plates, and said pivotable plate portions of each of said foldable plates are interconnected in such a manner that, when said first foldable frame member is in the unfolded state, each of said pivot plate portions is pivotable in only a direction toward the other end of the corresponding one of said non-foldable plates.

8. The bedstead assembly as claimed in Claim 1, wherein said pivot unit includes two side sleeves disposed on said one of said first and second foldable frame members, a middle sleeve disposed on the other of said first and second foldable frame members and between said side sleeves, and a pivot pin extending through said side and middle sleeves such that said first and second foldable frame members are pivotable relative to each other about said pivot pin.

9. The bedstead assembly as claimed in claim 1, wherein said void spaces in said first foldable frame member are arranged in a row along a direction generally perpendicular to said non-foldable plates.

10. A bedstead assembly comprising a rigid support frame, a top plate unit disposed on and above said support frame, and an electrical air pump unit disposed at least partially within said bedstead assembly, wherein said support frame is convertible between unfolded and folded states, wherein said support frame further comprises at least one pivot unit, a first foldable frame member, and a second foldable frame member having an end connected pivotally to an end of said first foldable frame member by said pivot unit, each of said first and second foldable frame members including two parallel non-foldable plates and two foldable plates, the non-foldable plates pivotally interconnected with said foldable plates to define a void space when said support frame is in the unfolded state, each of said foldable plates including two pivotable plate portions having outer ends connected respectively and pivotally to said non-foldable plates such that each of said pivotable plate portions is pivotable relative to a corresponding one of said non-foldable plates about a first axis, and inner ends interconnected pivotally, said first and second foldable frame members having respectively aligned top surfaces, said pivot unit being disposed adjacent to said top surfaces such that one of said first and second foldable frame members is pivotable about a second axis to abut against said top surface of the other of said first and second foldable frame member, said first and second axes forming an angle therebetween, said pivotable plate portions being generally perpendicular to said non-foldable plates when said support frame is in the unfolded state and being generally parallel to said non-foldable plates when said support frame is in the folded state.

11. The bedstead assembly as claimed in claim 1, wherein said first foldable frame member includes a plurality of pairs of foldable plates.

* * * * *